US008826489B2

(12) United States Patent
Oh et al.

(10) Patent No.: US 8,826,489 B2
(45) Date of Patent: Sep. 9, 2014

(54) SUCTION BODY PROVIDING ELECTRIC ENERGY AND CLEANER HAVING THE SAME

(75) Inventors: Jang-Keun Oh, Gwangju (KR); Hyun-Ju Lee, Gwangju (KR); Seung-Yong Cha, Gwangju (KR)

(73) Assignee: Samsung Electronics Co., Ltd. (KR)

( * ) Notice: Subject to any disclaimer, the term of this patent is extended or adjusted under 35 U.S.C. 154(b) by 656 days.

(21) Appl. No.: 12/661,199

(22) Filed: Mar. 12, 2010

(65) Prior Publication Data

US 2010/0263160 A1 Oct. 21, 2010

(30) Foreign Application Priority Data

Apr. 20, 2009 (KR) ..... 10-2009-0034261

(51) Int. Cl.

| | |
|---|---|
| ***A47L 9/00*** | (2006.01) |
| ***A47L 9/28*** | (2006.01) |
| ***A47L 9/04*** | (2006.01) |
| ***A47L 9/30*** | (2006.01) |

(52) U.S. Cl.

CPC ..... *A47L 9/0416* (2013.01); *A47L 9/2868* (2013.01); *A47L 9/30* (2013.01); *A47L 9/281* (2013.01); *A47L 9/2857* (2013.01)

USPC ..... 15/322; 15/324; 15/339; 15/412

(58) Field of Classification Search

USPC ..... 15/322, 324, 339, 412; 362/642

See application file for complete search history.

(56) References Cited

U.S. PATENT DOCUMENTS

| | | | | |
|---|---|---|---|---|
| 2,915,774 | A | 12/1959 | Darrow | |
| 4,829,625 | A * | 5/1989 | Wang | 15/422.2 |
| 2005/0115014 | A1 * | 6/2005 | Worwag | 15/324 |
| 2006/0285325 | A1 * | 12/2006 | Ducharme et al. | 362/231 |
| 2008/0061252 | A1 * | 3/2008 | Garcia et al. | 250/504 H |
| 2009/0183335 | A1 * | 7/2009 | Griffith et al. | 15/322 |

FOREIGN PATENT DOCUMENTS

| | | |
|---|---|---|
| JP | 5844021 | 3/1983 |
| JP | 61240932 | 10/1986 |
| JP | 02152419 | 6/1990 |
| JP | 08322766 | 12/1996 |
| KR | 898953 | 6/1989 |
| KR | 201990018992 | 12/1990 |
| KR | 1019970079744 | 12/1997 |

(Continued)

OTHER PUBLICATIONS

Extended European Search Report dated Jun. 11, 2012 corresponding to European Patent Application No. 10160070.8-2316.

*Primary Examiner* — Joseph J Hail
*Assistant Examiner* — Henry Hong
(74) *Attorney, Agent, or Firm* — Ohlandt, Greeley, Ruggiero & Perle, L.L.P.

(57) ABSTRACT

A suction body for a cleaner is provided that can generate electric energy by itself using air drawn in by the cleaner. A suction body includes an ultraviolet sterilizer that radiates ultraviolet rays toward a surface to be cleaned and sterilizes the surface to be cleaned, a lighting device that emits light, a displaying device that displays a cleaning state, a fan that rotates by drawn-in air, and a generator that converts rotary energy of the fan into electric energy so as to supply the electric energy to the ultraviolet sterilizer, the lighting device, and the displaying device.

20 Claims, 7 Drawing Sheets

(56) References Cited

FOREIGN PATENT DOCUMENTS

| | | |
|---|---|---|
| KR | 1020040047368 | 11/2002 |
| KR | 1020050041644 | 10/2003 |
| KR | 1020060020562 | 9/2004 |
| KR | 1020060093935 | 2/2005 |
| KR | 1020070036106 | 3/2007 |
| WO | 2006/015390 | 2/2006 |

* cited by examiner

SUCTION BODY PROVIDING ELECTRIC ENERGY AND CLEANER HAVING THE SAME

CROSS-REFERENCE TO RELATED APPLICATIONS

This application claims the benefit under 35 U.S.C. §119 (a) of Korean Patent Application No. 10-2009-0034261, filed in the Korean Intellectual Property Office on Apr. 20, 2009, the entire disclosure of which is incorporated herein by reference.

BACKGROUND OF THE INVENTION

1. Field of the Invention

The present disclosure relates to a suction body for a cleaner, and more particularly to a suction body capable of providing electric energy.

2. Description of the Related Art

A general cleaner includes a suction body, a cleaner body, and a connection hose. The suction body draws in dust-laden air from a surface to be cleaned. A dust collecting apparatus and a motor are installed in the cleaner body. The motor generates a suction force to draw in dust-laden air, and the dust collecting apparatus separates dust from the dust-laden air. The connection hose connects the suction body with the cleaner body, and is made of a flexible material in order for a user to easily clean.

The dust-laden air drawn-in by the suction body enters the dust collecting apparatus in the cleaner body through the connection hose. Dust is separated from the air by the dust collecting apparatus and is collected in the dust receptacle, and the cleaned air is externally discharged from the cleaner.

Recently, in addition to simple cleaning function, an effort to apply diverse additional devices to the suction body has been increased for user convenience. An example of additional device is a lamp to light the front of the suction body. Such a lamp may be used when the user cleans a dark area. Other diverse additional devices may be applied to the suction body.

In order to operate an additional device, the electricity should be provided to the additional device. However, since the cleaner body is separated from the suction body, wires are necessary to connect the cleaner body with the suction body. Due to the wires, a manufacturing process may be complicated. In addition, since the cleaner body is distant from the suction body and the wires pass through the flexible connection hose, the wires may malfunction. In this case, the electricity is not supplied to the additional device at the suction body, so the additional device cannot operate.

SUMMARY OF THE INVENTION

An aspect of embodiments of the present disclosure is to solve at least the above problems and/or disadvantages and to provide a suction body capable of providing electric energy by itself using drawn-in air.

In order to achieve the above-described and other aspects of embodiments of the present disclosure, a suction body is provided including an ultraviolet sterilizer that radiates ultraviolet rays toward a surface to be cleaned and sterilizes the surface to be cleaned, a lighting device that emits light, a displaying device that displays a cleaning state, a fan that rotates by a drawn-in air, and a generator that converts rotary energy of the fan into electric energy so as to supply the electric energy to the ultraviolet sterilizer, the lighting device, and the displaying device.

The suction body may further include a rotating brush that scatters dust attached to the surface to be cleaned, and a transmission unit that transmits the rotary energy of the fan to the rotating brush.

The generator may be connected to a shaft of the fan.

The ultraviolet sterilizer may include an ultraviolet radiation unit that radiates the ultraviolet rays, and a cover unit that transmits the ultraviolet rays radiated from the ultraviolet radiation unit that and prevents damage of the ultraviolet radiation unit.

The ultraviolet radiation unit may include an ultraviolet light emitting diode (LED).

The ultraviolet radiation unit may include an ultraviolet lamp.

The cover unit may include a film formed of polytetrafluoroethylene or PTFE, such as PTFE that is commercially available under the trade name TEFLON, that transmits the ultraviolet rays radiated from the ultraviolet radiation unit, and a cover frame that is formed on a periphery of the Teflon film.

The PTFE film and the cover frame may be integrally formed with each other using two-shot molding.

Coupling holes may be formed on the periphery of the PTFE film.

The cover unit may include a mesh that has pores to transmit the ultraviolet rays radiated from the ultraviolet radiation unit, and a cover frame that is formed on a periphery of the mesh.

The cleaning state displayed by the displaying device may indicate an amount of dust drawn in by the suction body.

The lighting device may include a colorless LED, and the displaying device may include a colored LED.

The colorless LED and the colored LED may be mounted together on a single substrate.

An amount of light emitted from the colorless LED may change according to environmental illumination.

An amount of light emitted from the colored LED may change according to the cleaning state.

In order to achieve the above-described and other aspects of embodiments of the present disclosure, a cleaner is provided including a suction body that draws in dust-laden air from a surface to be cleaned as described above, and a cleaner body in which a motor is mounted to generate a suction force.

BRIEF DESCRIPTION OF THE DRAWINGS

These and/or other aspects and advantages of the invention will become apparent and more readily appreciated from the following description and the accompanying drawings of which.

DETAILED DESCRIPTION OF THE PRESENT DISCLOSURE

Figure 1:
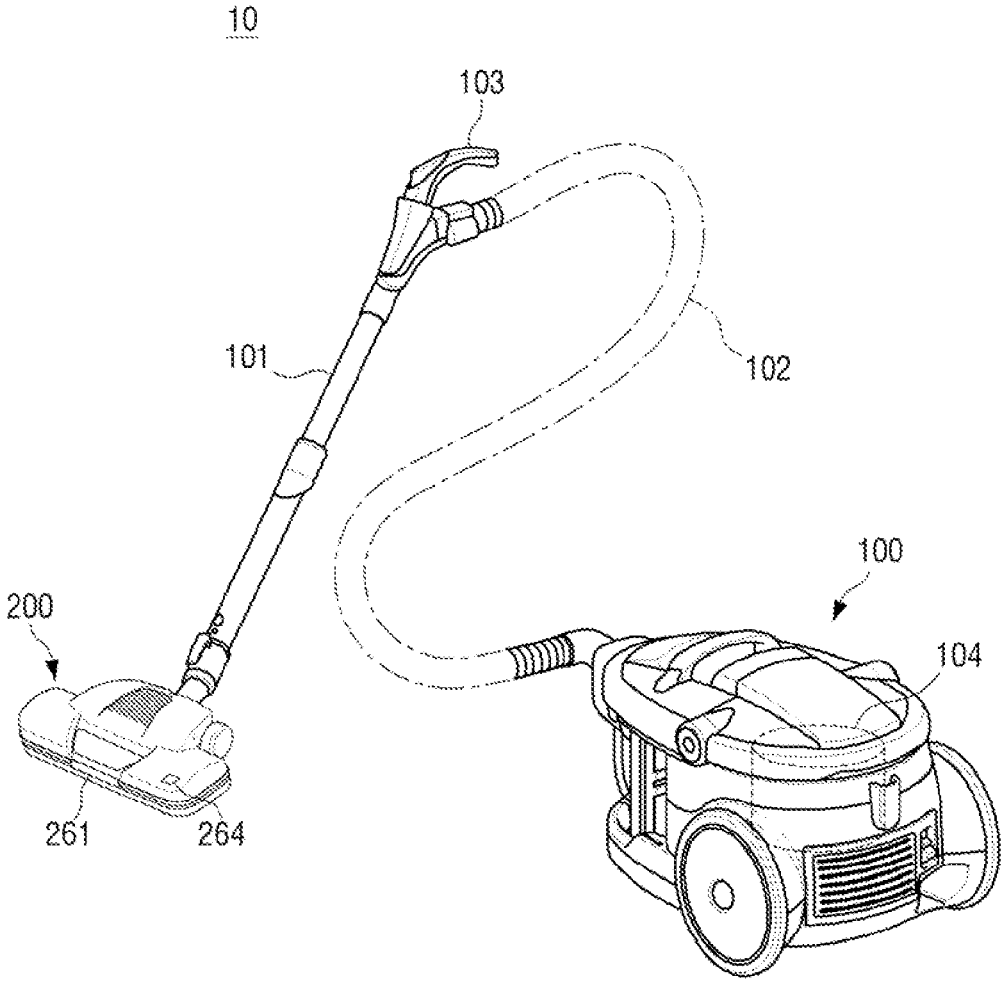
FIG. 1 is a perspective view illustrating a cleaner according to an exemplary embodiment of the present disclosure.

Reference will now be made to the accompanying drawings, wherein like reference numerals refer to like elements throughout. The embodiments are described below in order to explain the present disclosure by referring to the figures.

FIG. 1 is a perspective view illustrating a cleaner 10 according to an exemplary embodiment of the present disclosure.

The cleaner 10 may include a cleaner body 100 and a suction body 200. A motor 104 for generating a suction force is installed in the cleaner body 100. The suction body 200 draws in dust-laden air from a surface to be cleaned using the suction force of the motor 104.

The suction body 200 is connected to the cleaner body 100 through a suction pipe 101 and a connection hose 102. The length of the suction pipe 101 may be adjustable for convenience of cleaning and storage. A handle 103 to be held by a user is disposed on one end of the suction pipe 101. The connection hose 102 is made of a flexible material, so if the user is holding the handle 103 and cleaning, the connection hose 102 may be bendable.

The dust-laden air drawn in by the suction body 200 passes through the suction pipe 101 and the connection hose 102 and enters the cleaner body 100. Subsequently, the dust-laden air enters a dust collecting apparatus (not shown) installed in the cleaner body 100, and is divided into dust and air. The dust is collected in a dust receptacle, and the cleaned air is externally discharged from the cleaner 10.

The cleaner shown in FIG. 1 is a canister cleaner, and the technical idea of the present disclosure may also be applied to upright cleaners.

The suction body 200 according to an exemplary embodiment of the present disclosure is described in detail below with reference to FIGS. 2-9.

Figure 2:
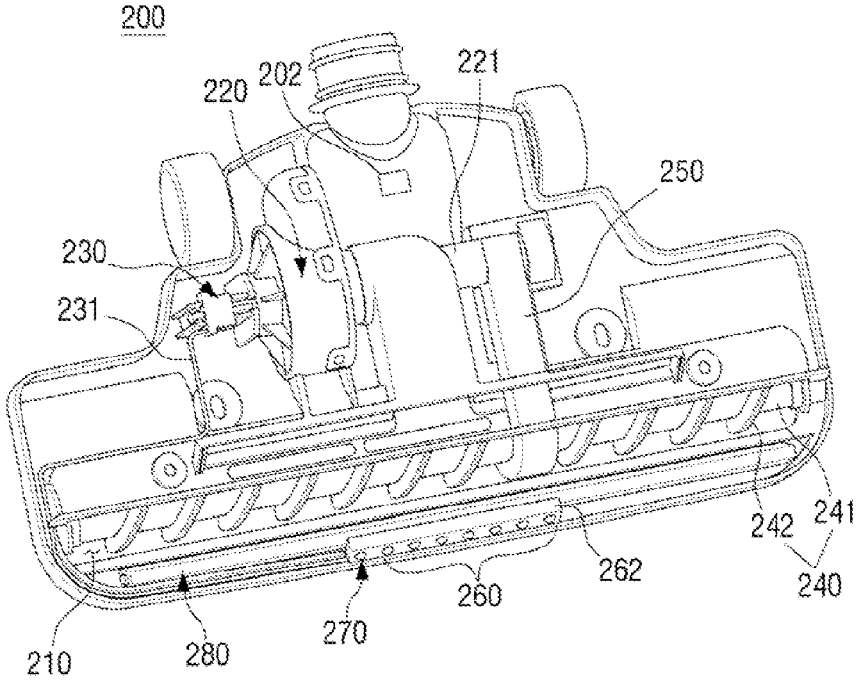
FIG. 2 is a perspective view illustrating the inside of the suction body shown in FIG. 1.
Figure 3:
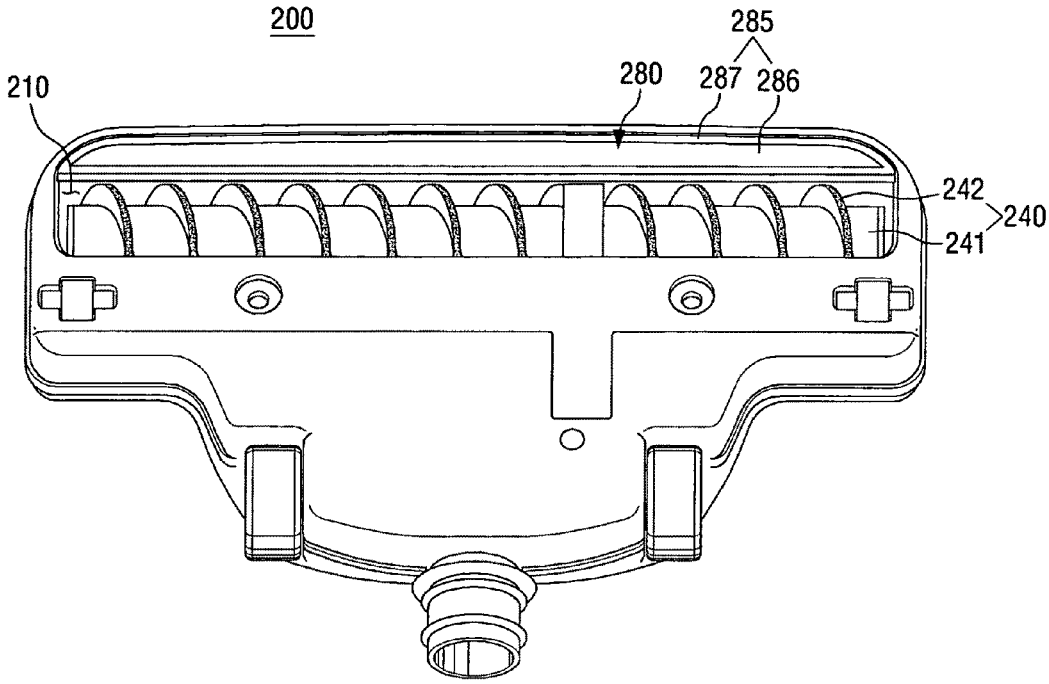
FIG. 3 is a perspective view illustrating the underbody of the suction body shown in FIG. 2.

FIG. 2 is a perspective view illustrating the inside of the suction body 200 shown in FIG. 1, and FIG. 3 is a perspective view illustrating the underbody of the suction body 200 shown in FIG. 2.

As illustrated in FIGS. 2 and 3, the suction body 200 may include a suction port 210, a fan 220, a generator 230, a rotating brush 240, a transmission unit 250, a lighting device 260, a displaying device 270, and an ultraviolet sterilizer 280.

The suction port 210 is formed on a bottom surface of the suction body 200, so dust-laden air is drawn from the surface to be cleaned into the suction body 200 through the suction port 210. As described above, the dust-laden air drawn into the suction body 200 passes through the suction pipe 101 and the connection hose 102 and enters the dust collecting apparatus in the cleaner body 100.

The fan 220 is installed on an air path of the drawn-in air, so if the air passes through the fan 220, the fan 220 may rotate. Reference numeral 221 shown in FIG. 2 indicates a shaft of the fan 220.

The generator 230 converts rotation energy of the fan 220 into electric energy. As illustrated in FIG. 2, the generator 230 is connected to the shaft 221 of the fan 220 and generates electric energy using a rotary motion of the shaft 221 of the fan 220. The operating principles of the generator 230 are well understood by those skilled in the art, so detailed description is omitted here. The electric energy generated by the generator 230 is supplied to the lighting device 260, the displaying device 270, and the ultraviolet sterilizer 280 through a wire 231.

The rotating brush 240 scatters dust attached to the surface to be cleaned. The rotating brush 240 includes a rotating drum 241 that rotates in association with the shaft 221 of the fan 220, and a brush 242 that is attached to the external surface of the rotating drum 241. Since the brush 242 scatters dust on the surface to be cleaned while the rotating drum 241 is rotating, the cleaning efficiency may be improved.

The transmission unit 250 transmits rotary power of the fan 220 to the rotating brush 240. Accordingly, if the fan 220 rotates, the rotating drum 241 of the rotating brush 240 also rotates. In FIG. 2, a friction belt is used as an example of the transmission unit 250, but the transmission unit 250 is not limited thereto. Diverse kinds of transmission units may be used.

According to the exemplary embodiment of the present disclosure, it is possible to operate the rotating brush 240, the lighting device 260, the displaying device 270, and the ultraviolet sterilizer 280, all of which are installed in the suction body 200, using rotation of the fan 220 without receiving electric energy from the cleaner body 100. This is because electric energy that is needed for the lighting device 260, the displaying device 270, and the ultraviolet sterilizer 280 can be supplied using the generator 230, and driving power that is needed for the rotating brush 240 can be supplied using the transmission unit 250. Consequently, since a wire is not required between the cleaner body 100 and the suction body 200, a manufacturing process may be simplified, and cutoff of a wire between the cleaner body 100 and the suction body 200 may be eliminated.

Figure 4:
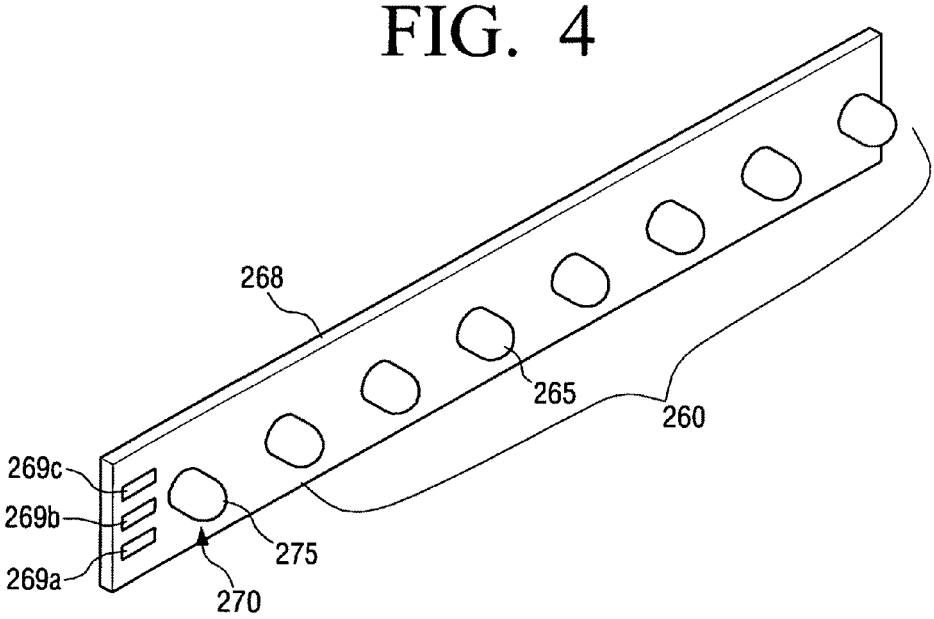
FIG. 4 is a perspective view illustrating a lighting device and a displaying device.

FIG. 4 is a perspective view illustrating the lighting device 260 and the displaying device 270.

The lighting device 260 emits light, and thus helps the user clean a dark area. The light emitted from the lighting device 260 passes through a lighting window 261 (see FIG. 1) and projects in front of the suction body 200. The lighting device 260 is mounted on a lighting device mounting unit 262 (see FIG. 2). The lighting device 260 may include a colorless light emitting diode (LED) 265, which emits substantially white light. In this exemplary embodiment of the present disclosure regarding the suction body 200 providing electric energy by itself, it is preferable to use an LED that consumes less power than other light emitting devices. The amount of light emitted from the colorless LED 265 may change according to environmental illumination. To this end, an illumination sensor 264 may be added in order to sense environmental illumination. The environmental illumination sensed by the illumination sensor 264 is input to the lighting device 260, so the amount of light emitted from the colorless LED 265 can be adjusted appropriately. The illumination sensor 264 is well understood by those skilled in the art, so detailed description is omitted here.

The displaying device 270 displays a cleaning state. To discriminate light of the displaying device 270 from light of the lighting device 260, the displaying device 270 may include a colored LED 275. For convenience of description, it is assumed that the colored LED 275 is an LED that emits red light. The user can identify the cleaning state by looking at the red light emitted by the red LED 275.

The cleaning state displayed by the displaying device 270 may indicate, for example, the amount of dust drawn in by the suction body 200. To this end, a dust sensor 202 for sensing the amount of drawn-in dust may be additionally installed. The dust sensor 202 is well understood by those skilled in the art, so detailed description is omitted here. According to the amount of drawn-in dust sensed by the dust sensor 202, the amount of light emitted by the red LED 275 may change. That is, if the amount of drawn-in dust is large, the red light is strong, and if the amount of drawn-in dust is small, the red light is weak. Accordingly, the user can identify whether or not cleaning is being well performed by looking at the red light emitted by the red LED 275.

The displaying device 270 may display diverse information other than the amount of dust drawn in by the suction body 200. To this end, the displaying device 270 may further include LEDs that emits light of other colors other than the red LED 275 which can be discriminated from light of the lighting device 260.

As illustrated in FIG. 4, in order to reduce the manufacturing cost and manufacturing process, the colorless LED 265 and the colored LED 275 may be mounted together on a single substrate 268. A power connector 269*a* and signal connectors 269*b* and 269*c* are disposed on one side of the substrate 268. The power connector 269*a* is connected to the wire 231 to receive electric energy from the generator 230. The signal connectors 269*b* and 269*c* receive signals sensed by the illumination sensor 264 and the dust sensor 202. However, the position of the displaying device 270 is not limited thereto, and may be separated from the lighting device 260.

The ultraviolet sterilizer 280 radiates ultraviolet rays, which can sterilize the surface to be cleaned. As illustrated in FIG. 3, the ultraviolet sterilizer 280 is formed on the bottom surface of the suction body 200. The ultraviolet sterilizer 280 may include an ultraviolet radiation unit 281 and a cover unit 285.

Figure 5:
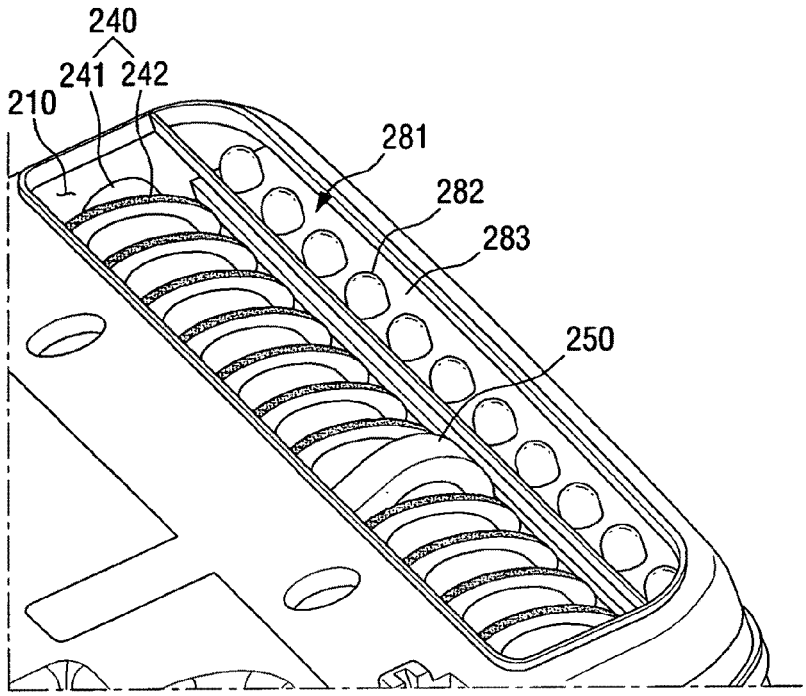
FIG. 5 is a perspective view illustrating an example of ultraviolet radiation unit.

The ultraviolet radiation unit 281 radiates ultraviolet rays. FIG. 5 is a perspective view illustrating an example of ultraviolet radiation unit 281. For convenience of description, in FIG. 5, the cover unit 285 hiding the ultraviolet radiation unit 281 (see FIG. 3) is not illustrated in order to show the ultraviolet radiation unit 281. The ultraviolet radiation unit 281 may include ultraviolet LEDs 282. Ultraviolet rays are radiated from the ultraviolet LEDs 282 toward the surface to be cleaned. Reference numeral 283 indicates a substrate on which the ultraviolet LEDs 282 are mounted.

Figure 6:
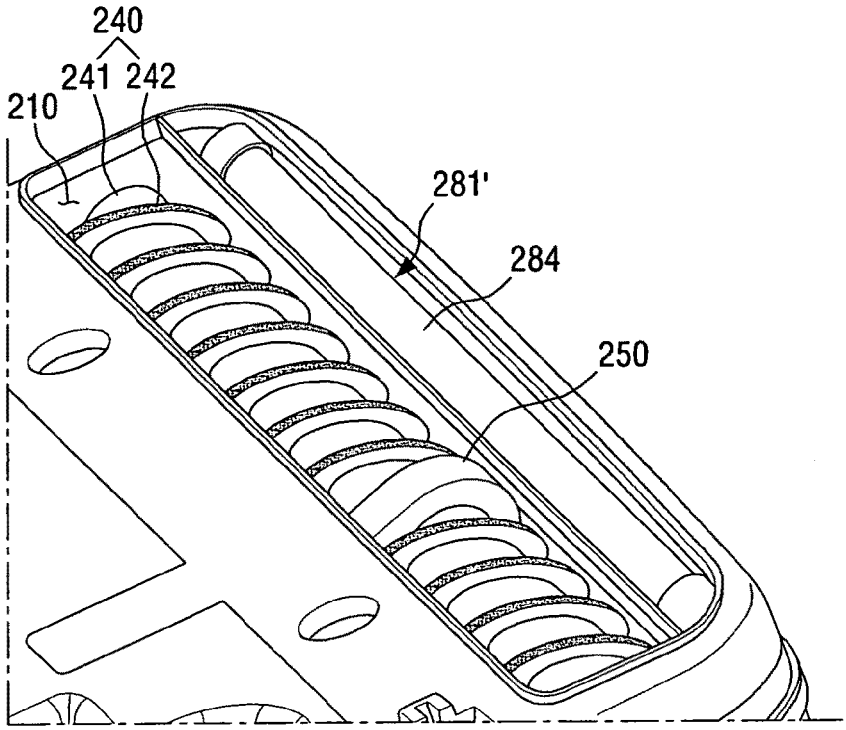
FIG. 6 is a perspective view illustrating another example of ultraviolet radiation unit.

FIG. 6 is a perspective view illustrating another example of ultraviolet radiation unit 281'. In FIG. 6, the cover unit 285 hiding the ultraviolet radiation unit 281' is not illustrated in order to show the ultraviolet radiation unit 281' as in FIG. 5. The ultraviolet radiation unit 281' may include an ultraviolet lamp 284. The ultraviolet lamp 284 is well understood by those skilled in the art, so detailed description is omitted here.

The cover unit 285 prevents damage of the ultraviolet radiation unit 281. To this end, the cover unit 285 is disposed under the ultraviolet radiation unit 281. If the ultraviolet radiation unit 281 or 281' is exposed outside, the ultraviolet radiation unit 281 or 281' may be damaged during the cleaning, so the cover unit 285 protects the ultraviolet radiation unit 281 or 281' from the external impact. In addition, the cover unit 285 protects the amount of ultraviolet rays being radiated to the surface to be cleaned from being reduced due to dust attached to the ultraviolet radiation unit 281 or 281'. In order to sterilize the surface to be cleaned, the cover unit 285 should transmit ultraviolet rays radiated from the ultraviolet radiation unit 281 or 281'.

Figure 7:
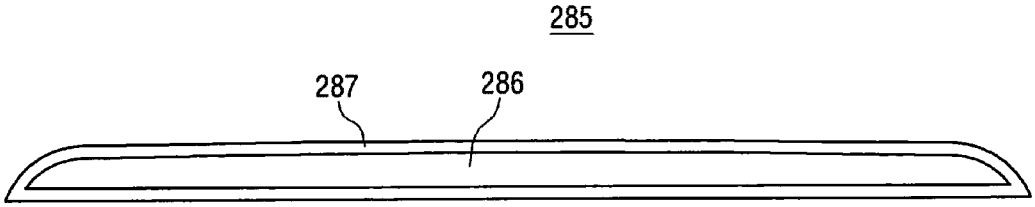
FIG. 7 is a plane view illustrating the cover unit shown in FIG. 3.

FIG. 7 is a plane view illustrating the cover unit 285 shown in FIG. 3. The cover unit 285 may include a PTFE film 286 and a cover frame 287.

Since PTFE generally has a high ultraviolet permeability, the PTFE film 286 can transmit ultraviolet rays radiated from the ultraviolet radiation unit 281. The cover frame 287 is formed on the periphery of the PTFE film 286.

Figure 8:
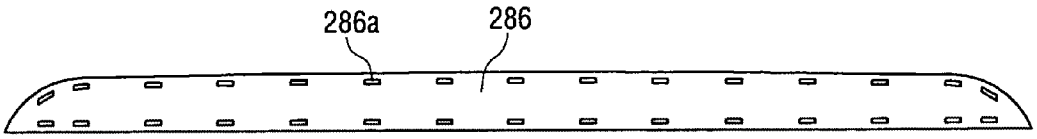
FIG. 8 is a plane view illustrating a PTFE film of the cover unit shown in FIG. 7.

Since PTFE has a low affinity with other materials, PTFE is not attached to other materials. Accordingly, in the cover unit 285 according to this exemplary embodiment of the present disclosure, the PTFE film 286 and the cover frame 287 are integrally formed with each other using two-shot molding. That is, the PTFE film 286 is formed using the first molding of PTFE as illustrated in FIG. 8. As illustrated in FIG. 8, coupling holes 286*a* are formed on the periphery of the PTFE film 286 to be coupled with the cover frame 287. Subsequently, the cover unit 285 shown in FIG. 7 is made by the second molding of a general plastic on the periphery of the PTFE film 286 and through the coupling holes 286*a*. According to this exemplary embodiment of the present disclosure, the material property of PTFE that PTFE is difficult to be attached to other materials can be overcome using two-shot molding.

Figure 9:
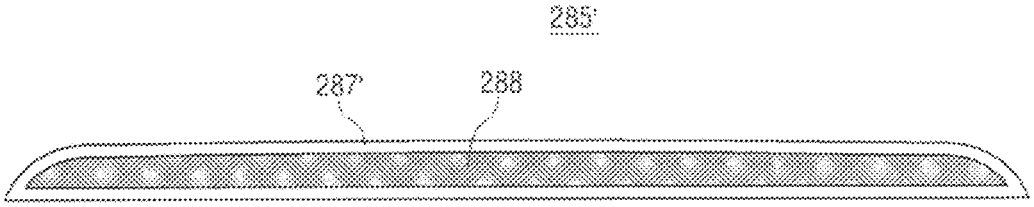
FIG. 9 is a plane view illustrating another example of cover unit.

FIG. 9 is a plane view illustrating another example of cover unit 285'.

As illustrated in FIG. 9, the cover unit 285' may include a mesh 288 and a cover frame 287'. Unlike the exemplary embodiment shown in FIG. 7, the PTFE film 286 is replaced with the mesh 288. The mesh 288 has pores to transmit the ultraviolet rays radiated from the ultraviolet radiation unit 281.

While the invention has been shown and described with reference to certain embodiments thereof, it will be understood by those skilled in the art that various changes in form and details may be made therein without departing from the spirit and scope of the invention as defined by the appended claims.

What is claimed is:

1. A cleaner comprising:

a cleaner body in which a motor is mounted to generate a suction force; and a suction body in fluid communication with the suction force of the cleaner body so that the suction body draws in dust-laden air from a surface to be cleaned, wherein the suction body comprises:

a fan that rotates using drawn-in air;

a dust sensor in the suction body that senses an amount of dust in drawn-in air;

an ultraviolet light emitting diode on a bottom surface of the suction body that radiates ultraviolet rays toward the surface to be cleaned;

a cover unit on the bottom surface that transmits the ultraviolet rays radiated from the ultraviolet light emitting diode and prevents damage of the ultraviolet light emitting diode;

a first light emitting diode on a front surface of the suction body that projects light in front of the suction body;

a second light emitting diode on the front surface of the suction body that indicates the amount of dust sensed by the dust sensor;

a transmission unit that transmits the rotary energy of the fan to a rotating brush so as to scatter dust attached to the surface to be cleaned; and a generator that converts rotary energy of the fan into electric energy so as to supply the electric energy to the dust sensor, the ultraviolet light emitting diode, the first light emitting diode, and the second light emitting diode through a wire that does not pass between the suction body and the cleaner body, wherein the first and second light emitting diodes are mounted together on a single substrate, and wherein the single substrate comprises a power connector and a signal connector disposed on one side of the substrate, the power connector being connected to the generator to receive the electric energy and the signal connector being connected to the dust sensor to receive a signal indicative of the amount of dust in the drawn-in air.

2. The cleaner according to claim 1, wherein the generator is connected to a shaft of the fan.

3. The cleaner according to claim 1, wherein the first light emitting diode comprises a colorless light emitting diode.

4. The cleaner according to claim 1, wherein the second light emitting diode comprises a colored light emitting diode.

5. The cleaner according to claim 1, further comprising an illumination sensor that senses an amount of environmental illumination, the generator supplying the electric energy to the illumination sensor.

6. The cleaner according to claim 5, wherein the first light emitting diode emits an amount of light that changes according to the environmental illumination.

7. The cleaner according to claim 5, wherein the signal connector comprises a first signal connector and a second signal connector disposed on one side of the substrate, the first signal connector being connected to the dust sensor to receive the signal indicative of the amount of dust in the drawn-in air, and the second signal connector being connected to the illumination sensor to receive a signal indicative of the environmental illumination.

8. The cleaner according to claim 1, wherein the cover unit comprises:

a polytetrafluoroethylene film that transmits the ultraviolet rays; and a cover frame that is on a periphery of the polytetrafluoroethylene film.

9. The cleaner according to claim 8, further comprising coupling holes are formed on the periphery of the polytetrafluoroethylene film.

10. The cleaner according to claim 9, wherein the polytetrafluoroethylene film and the cover frame are integrally formed with each other using two-shot molding of the cover frame on the periphery and in the coupling holes.

11. The cleaner according to claim 1, wherein the cover unit comprises:

a mesh that has pores to transmit the ultraviolet rays radiated from the ultraviolet radiation unit; and a cover frame that is formed on a periphery of the mesh.

12. A cleaner comprising:

a cleaner body in which a motor is mounted to generate a suction force; and a suction body in fluid communication with the suction force of the cleaner body so that the suction body draws in dust-laden air from a surface to be cleaned, wherein the suction body comprises:

a fan that rotates using drawn-in air;

a dust sensor in the suction body that senses an amount of dust in drawn-in air;

an ultraviolet light emitting diode on a bottom surface of the suction body that radiates ultraviolet rays toward the surface to be cleaned;

a cover unit on the bottom surface that transmits the ultraviolet rays radiated from the ultraviolet light emitting diode and prevents damage of the ultraviolet light emitting diode;

a first light emitting diode on a front surface of the suction body that projects light in front of the suction body;

a second light emitting diode on the front surface of the suction body that indicates the amount of dust sensed by the dust sensor;

a transmission unit that transmits the rotary energy of the fan to a rotating brush so as to scatter dust attached to the surface to be cleaned;

a generator that converts rotary energy of the fan into electric energy so as to supply the electric energy to the dust sensor, the ultraviolet light emitting diode, the first light emitting diode, and the second light emitting diode through a wire that does not pass between the suction body and the cleaner body; ad an illumination sensor that senses an amount of environmental illumination, the generator supplying the electric energy to the illumination sensor, wherein the first and second light emitting diodes are mounted together on a single substrate that comprises a power connector, a first signal connector, and a second signal connector disposed on one side of the substrate, the power connector being connected to the generator to receive the electric energy, the first signal connector being connected to the dust sensor to receive a signal indicative of the amount of dust in the drawn-in air, and the second signal connector being connected to the illumination sensor to receive a signal indicative of the environmental illumination.

13. The cleaner according to claim 12, wherein the generator is connected to a shaft of the fan.

14. The cleaner according to claim 12, wherein the first light emitting diode comprises a colorless light emitting diode.

15. The cleaner according to claim 12, wherein the second light emitting diode comprises a colored light emitting diode.

16. The cleaner according to claim 12, wherein the first light emitting diode emits an amount of light that changes according to the environmental illumination.

17. The cleaner according to claim 12, wherein the cover unit comprises:

a polytetrafluoroethylene film that transmits the ultraviolet rays; and a cover frame that is on a periphery of the polytetrafluoroethylene film.

18. The cleaner according to claim 17, further comprising coupling holes are formed on the periphery of the polytetrafluoroethylene film.

19. The cleaner according to claim 18, wherein the polytetrafluoroethylene film and the cover frame are integrally formed with each other using two-shot molding of the cover frame on the periphery and in the coupling holes.

20. The cleaner according to claim 12, wherein the cover unit comprises:

a mesh that has pores to transmit the ultraviolet rays radiated from the ultraviolet radiation unit; and a cover frame that is formed on a periphery of the mesh.

* * * * *